United States Patent [19]

Lederrey

[11] 4,397,566

[45] Aug. 9, 1983

[54] WRIST-WATCH CASING

[75] Inventor: Marc Lederrey, Le Landeron, Switzerland

[73] Assignee: Montres Rado S.A., Biel, Switzerland

[21] Appl. No.: 374,689

[22] Filed: May 4, 1982

[51] Int. Cl.[3] ..... G04B 37/08; G04B 19/24

[52] U.S. Cl. ..... 368/291; 368/276; 368/287; 368/292

[58] Field of Search ..... 368/276, 285, 291, 294, 368/295, 296, 299, 300, 309, 82, 286, 292, 287

[56] References Cited

U.S. PATENT DOCUMENTS

| | | | |
|---|---|---|---|
| 2,727,354 | 12/1955 | Ochs | 368/287 |
| 3,241,308 | 3/1966 | Forney | 368/276 X |
| 3,242,664 | 3/1966 | Lederrey | 368/285 X |
| 3,756,017 | 9/1973 | Genta | 368/291 |
| 3,777,473 | 12/1973 | Bussi | 368/292 |
| 3,952,499 | 4/1976 | Reisman | 368/276 |
| 4,197,747 | 4/1980 | Koehler | 368/286 X |
| 4,281,406 | 7/1981 | Tanaka | 368/82 |

FOREIGN PATENT DOCUMENTS 2397668 7/1978 France .

55-70770 5/1980 Japan .

*Primary Examiner*—J. V. Truhe
*Assistant Examiner*—Terrance Flower
*Attorney, Agent, or Firm*—Parkhurst & Oliff

[57] ABSTRACT

The glass (1) of the wrist-watch casing carries the ornamental pieces of the casing visible face surrounding the watch dial (17). These pieces comprise a frame (2) of precious or semi-precious material or a very thin metallized layer (31) deposited under the glass (1). The frame (2) is glued in an indissoluble and resistant manner under glass (1) and a spacing frame (3) is similarly glued under frame (2). The collar (6) of tapped sockets (5) is caught and glued in lodgings (7) provided in the face of frame (3) which is glued to frame (2). The unit composed of these pieces (2, 3, 5) and the glass (1) are removably secured to the caseband (8) by means of screws (9) crossing the caseband and engaging sockets (5) fitting borings (19) of the caseband.

Under the metallized layer (31) a single spacing frame (25) of base metal is necessary and sockets (5) are welded in lodgings (26) of that frame.

10 Claims, 4 Drawing Figures

WRIST-WATCH CASING

BACKGROUND OF THE INVENTION

1. Field of the Invention

This invention relates to wrist-watch casings in particular of the type in which the glass is removably secured to the caseband by means of screws set in place from the bottom side of the casing and screwed into tapped bores of members forming part of a unit which is solid with the glass.

2. Description of the Prior Art

Wrist-watch casings of this type have been disclosed in JP-A-55 70 770 and in the corresponding U.S. Pat. No. 4,281,406. Their use is however limited to watches with digital display means. Moreover, the members into which the glass fixing screws are screwed, consist of tapped feet integral with a frame surrounding the liquid criptal cell of the display means.

The limitation of that glass fixing mode to the watches with digital display is due to the fact that the glass and the frame solid therewith are set in a recess of the caseband which also constitutes a bezel of the casing. Therefore, said frame extends inwardly to a substantial extent in order to hide said feet which are located in the free space of the casing normally reserved for the watch movement.

Furthermore, a frame made integral with feet has not a simple shape and its manufacture is accordingly not especially cheap. A different frame must also be made not only for every shape and sizes of casing, but also for each particular frame feet location depending on the particular watch movement inserted in the casing.

In addition, the finishing operations of the visible face of the casing, especially of the bezel upper face which appears around the dial, are substantially more difficult with a non-circular casing than with a circular one. Finally, the appearance of the casing visible face (color and shape) can only be varied within very narrow limits, chiefly because of the material of the casing, its vulnerability or the resistance its opposes to machining operations.

SUMMARY OF THE INVENTION

With the casings according to the invention, the glass and the unit solid therewith cover and thus hide the whole caseband upper face. The glass area which accordingly remains transparent within said unit is relatively large so that analogical display means may appear therethrough without difficulty. Moreover, since the ornamental pieces constituting the casing visible face, are solid with the glass and accordingly protected by the same, the appearances range which the casing can be awarded is substantially amplified. In addition, the frame bond to the glass is a flat relatively thin piece which can be produced in series in a single step, while also forming the lodgings for the sockets, by punching it out of a sheet metal band. On the other hand, the sockets have always the same shape and sizes which do not depend on the casing sizes and shape. Accordingly these sockets can be lathe-turned in great series. Finally, gluing said frame to the glass has the advantage over the mechanical fixing means by fitting pieces in oneanother, not only to admit larger tolerances, but also to avoid internal stresses in the glass which can jeopardize its resistance, in particular if the latter is a sapphire.

Upon inserting ornamental pieces between said frame and the glass, it is possible to manufacture great series of identical casebands and nevertheless to produce numerous different watch patterns by securing glasses having different ornamental pieces to said casebands.

Since the frame bond to the glass covers the caseband, the sockets carried thereby can take place in borings provided across the caseband thus leaving the inner space of the caseband entirely free for the watch movement and providing positioning means for the glass being as accurate as they are simple.

The casings according to the invention even offers the possibility to secure an independent bottom to the caseband by means of the same screws as the glass. Scratchproof watches can finally be produced without resorting to the expensive sintering of hard metals, simply by making the glass out of sapphire, since the latter covers the whole casing face exposed to contacts with foreign bodies thus constituting a highly valuable shield.

BRIEF DESCRIPTION OF THE DRAWING

One embodiment and some modifications of the wrist-watch casing according to the invention are represented diagrammatically and by way of example in the accompanying drawing in which.

DESCRIPTION OF THE PREFERRED EMBODIMENT

Figure 1:
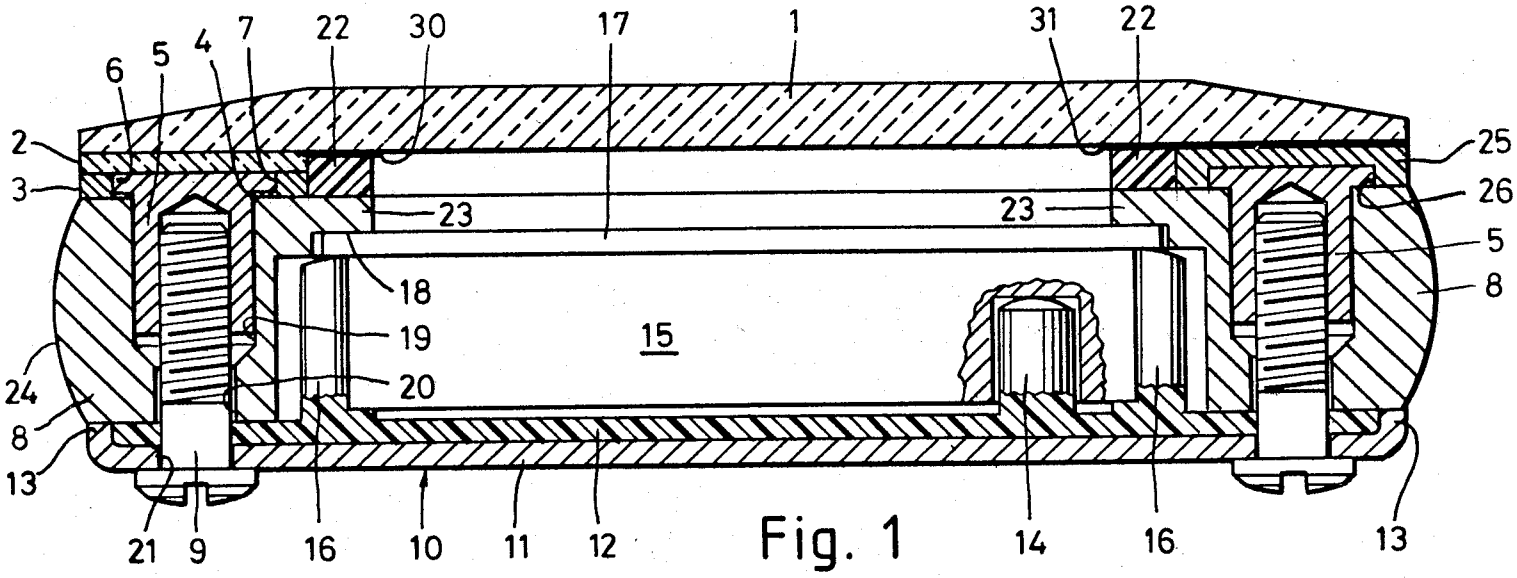
FIG. 1 is a sectional view showing that embodiment and a modification thereof.
Figure 3:
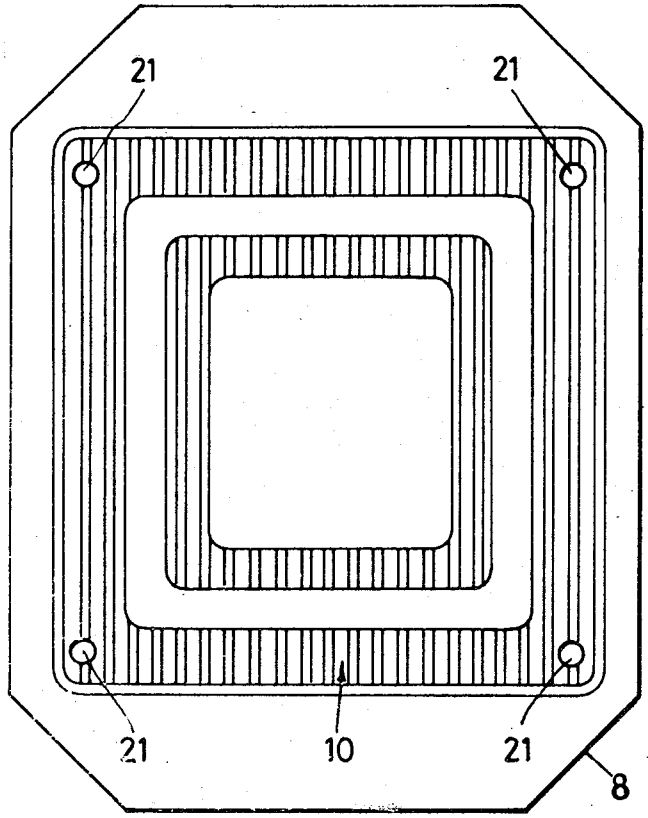
FIG. 3 is a plan view of the bottom side of the embodiment of FIG. 1.

The pecularities of the preferred embodiment of the present invention are shown in the left half of FIG. 1. The casing according to that embodiment generally has a rectangular shape. Its corners are truncated as shown in FIG. 3. The upper casing face, which is the sole being visible when the watch is carried, is wholly covered by the glass 1 consisting of a sapphire having beveled edges. A thin flat frame 2 is glued under the periphery of glass 1. Frame 2 is a precious or semi-precious stone such as for instance cat's or tiger eye, lapis lazuli, aquamarine, tourmaline, opal, amethyst, malachite, jasper, coral. It can, however, simpler be made out of a gold spangled colored material or a hard metal or even a base metal having its face glued to the glass nicely finished so as to constitute a decorative design. The mechanical properties, such as hardness, brittleness, of the material of frame 2, which constitute the ornamental piece of the casing and of the watch too, are immaterial because that frame is protected by the sapphire glass and cannot come in contact with foreign bodies. Its appearance is, of course, also sheltered from corrosion by chemical agents.

A second frame 3 of base metal is glued under frame 2. Frame 3 is also flat. It is provided with openings 4, usually four in number, for the passage of sockets 5. The latter are formed with a collar 6 around their bottom, which takes place in a lodging 7 of frame 3, which is formed in its face glued to frame 2. Collars 6 are thus caught between frames 2 and 3. Moreover, they are secured to said frames, as well as the bottom of sockets 5 by the glue binding the frames 2, 3 to each other. A non-circular contour of collars 6 would award even more security, if necessary. The unit comprising the two frames 2, 3 and the sockets 5 is itself solid with the glass so that the whole can be handled as a single piece when assembling the casing. The glues nowadays offered on the market enable joining the pieces described in an indissoluble manner and so as to obtain an adhesion of several kgp/mm$^2$.

The sockets 5 are provided with a tapped bore to enable securing the unit solid with the glass 1 to the caseband 8 by means of screws 9 which can be brought into engagement with sockets 5 by inserting them from the bottom side of the casing. On this side, the screws 9 could directly enter the caseband. In the embodiment disclosed, however, they secure at the same time an independent bottom 10 to the caseband 8. Bottom 10 and its mode of fixation to the caseband are disclosed in detail in the U.S. patent application Ser. No. 374,690.

As shown in FIG. 1, bottom 10 comprises a flat metallic plate 11 and a thin layer 12 of soft material lining the inner face of piece 11 to which it strongly adheres. Layer 12 preferably consists of an elastomer, for instance that sold under the trademark "VITON", which is mold under pressure in piece 11 so as to form what is called a "metal-elastomer junction". Piece 11 covers the whole lower face of caseband 8. Its edges 13 are bent upwards at right angles so as to come in abutting engagement with caseband 8 when screws 9 are screwed down in sockets 5. Besides the fact that with such an engagement no gap appears between the caseband and the bottom, the bearing of two metallic pieces against each other has the advantage to limit the pressure strength exerted on layer 12. The latter has, indeed, a peripheral lip somewhat higher than edges 13 of piece 11. That lip is flattened out by the caseband lower face in the position represented in FIG. 1 so as to form a tight seal between the caseband 8 and the bottom, whatever shape these pieces may have. Layer 12 is molded in one piece, firstly, with two upwardly extending cylindrical projections 14 which are substituted for the conventional screws fixing the watch movement 15 in the caseband 8 and assume the function of those screws, and secondly with four pillars 16 which firmly hold the parts of dial 17 projecting beyond the edge of the watch movement in abutting engagement with a shoulder 18 of caseband 8. In its middle area, on the inside of its peripheral lip and between projections 14 and pillars 16, the layer 12 could be interrupted thus leaving bare some portion of piece 11 of bottom 10 in order to make place for the thickest part of movement 15, for instance for the battery in a quartz watch.

To provide a passage for the screws 9, the caseband 8 is bored through and through, however at different diameters. In their larger upper part 19, the bores of caseband 8 are adjusted to sockets 5 in order that glass 1 and the unit solid therewith are exactly positionned on caseband 8, whereas the lower bore part 20 is only a little larger than screws 9 in order that the caseband presses the lip of layer 12 against a smoothly polished part of screws 9. The latter pass with some free play through bores 21 of the metallic piece 11 of bottom 10.

The tight seal of the gap between the glass and the caseband is ensured by a gasket 22 extending along the inner edges of frames 2, 3, the height of which at rest being a little greater than the thickness of both frames 2, 3. Once screws 9 are screwed down into sockets 5, the gasket 22 is consequently compressed in axial direction between the glass 1 and the inner rim 23 of caseband 8. A thin metallized layer 30 coats the area of the glass lower face, which extends over gasket 22 and the inner edge of frame 2 in order to hide this gasket and the possible irregularities of said edge of frame 2, while adding a supplemental ornament to the visible face of the casing. By means of masks it is, indeed, possible to obtain a rigorous demarcation of very thin metallized lines such as arabesques for instance.

To avoid the stress caused in the glass 1 by the compressed gasket 22, the frames 2, 3 could be enlarged inwardly up to the inner edge of rim 23 and the gasket be located under these frames in a groove of the caseband. With such a modification, the glass 1 would be free from any internal stress as desirable in the case of a sapphire glass.

The manufacture of the three independent pieces of the casing disclosed is easy. Since the frames glued under the glass 1 are flat, they can merely be punched out of a sheet metal. Since their fixation to the glass together with sockets 5 occurs by gluing, that step does not raise any problem. Machining the caseband 8 is simple too. Its outer side face 24 is the sole one which must be submitted to fine finishing operations, snce it is the sole caseband face which is apparent on the watch. Besides that face, the casing areas having some extension and being visible are protected by the sapphire glass. As regards the outer edge of frame 3, the thickness of which is smaller than half a millimeter, it can be serrated and thus constitute an original decorative casing element. Due to its very simple shape, the bottom 10 is also very easy to be manufactured.

The casing according to the present invention permits easier assembly of the watch components than any other presently known casings. It suffices, indeed, to set borings 19 of caseband 8 onto sockets 5 of the glass unit, then to set the bottom onto the caseband and to screw down the screws 9. Mounting the movement 15 into that casing does not require any particular operation; it suffices to deposit the same in caseband 8 wherein projections 14 and pillars 16 of the bottom automatically hold it in place as soon as the casing is closed by means of screws 9.

The right half of FIG. 1 shows a modification of the embodiment disclosed, which differs therefrom only by the nature of the elements fixed under the glass. In this modification, a thin metallized layer 31 is formed by evaporation in the vacuum on the whole peripheral zone of the glass lower face, which extends from the glass edge inwardly somewhat beyond the gasket 22. With this modification, it is said opaque metallized layer which confers the appearance to the casing face surrounding the watch dial.

A single frame 25 is here glued under the glass onto said metallized layer. To enable using the same caseband as with the embodiment disclosed hereabove and in order to provide the watch hands with a free space having the same height as with that embodiment, frame 25 has a thickness equal to that of the two frames 2, 3 together. Frame 25 is made out of base metal and sockets 5 are welded in lodgings 26 provided in the lower face of frame 25.

In this embodiment, frame 25 could also be enlarged inwardly up to the inner edge of rim 23 and the watertight gasket 22 be located between that frame and the caseband 8 in a groove of the latter.

Figure 2:
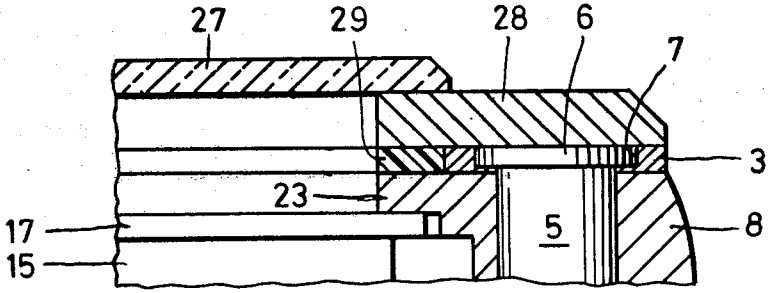
FIG. 2 is a partial cross-section of another modification.

FIG. 2 shows another modification of the embodiment disclosed hereabove. In this case, glass 27 does no longer cover the whole casing upper face. It is glued only onto the inner zone of the upper face of a hard metal frame 28. The inner edge of frame 28 is flush with that of rim 23 formed on the caseband which is the same as that of FIG. 1. A frame 3, identical with that of the embodiment disclosed hereabove, is glued under frame 28. The collars 6 of sockets 5 are caught in the same manner as that disclosed with reference to the left half of FIG. 1 so that these sockets are solid with the glass 27. A watertight gasket 29, the height of which is somewhat greater than the thickness of frame 3 is inserted between frame 28 and caseband 8.

This modification reserves between the dial 17 and the glass 27 a free space for the watch hands, which is a little higher than in FIG. 1, because of the thickness of the hard metal frame 28. Higher horal symbols can accordingly be provided on the dial 17.

Those skilled in the art will observe that the watch appearance chiefly depends on the ornamental pieces glued under the glass. Thus, by gluing different ornamental pieces under a series of glasses, a large scale of different patterns can be produced while manufacturing big series of identical casebands and identical bottoms. Assembling the casings according to the invention and mounting the watch movement into these casings always occurs in the same manner regardless of the casing shape which can be circular, rectangular, square, trapezoidal or in the form of any polygon with straight or curved edges.

Figure 4:
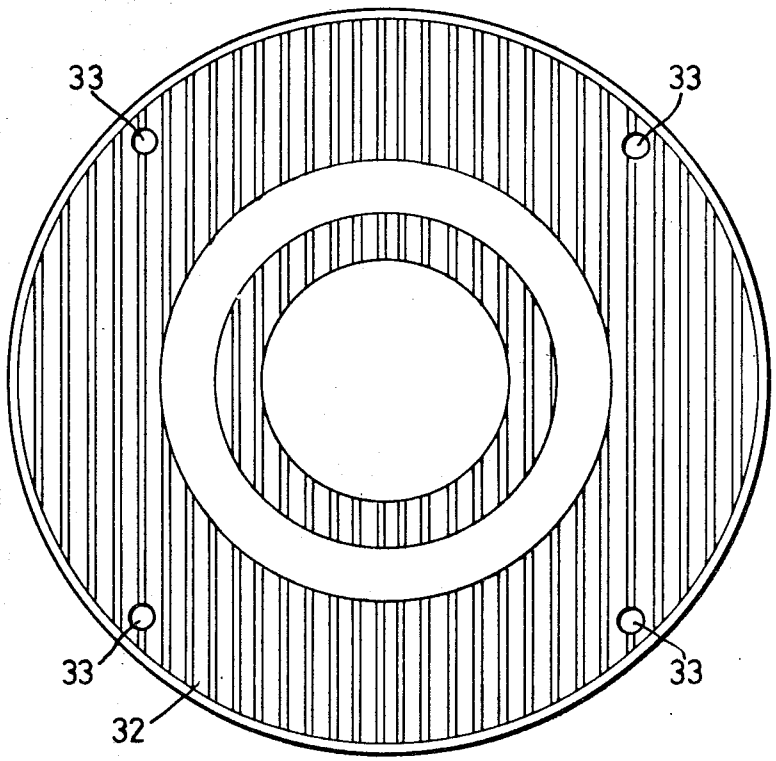
FIG. 4 is a view similar to that of FIG. 3, but showing another modification.

FIG. 3 shows the contour of casing 8 of the embodiment disclosed hereabove in a plan view from the bottom side of the casing. It shows furthermore, the location 21 of the screws 9 securing at the same time the bottom 10 and the glass 1 to the caseband 8. As regards FIG. 4, it shows that a circular bottom 32 can just as well be secured to the caseband together with the glass by means of screws inserted into bores 33.

What is claimed is:

1. A watchcase comprising a caseband having a substantially flat upper face and being adapted for receiving and surrounding a watch movement provided with an analogical time display means, a section of glass, having an opaque unit secured thereto, covering said upper face of the caseband, said unit including a flat frame secured to said glass, tapped sockets having a collar extending radially outwards at their base and being individually secured to said frame, screws screwed into said sockets from the bottom side of the watchcase for removably securing said glass and said unit to said caseband, said glass and opaque unit being dimensioned such that the entire analogical time display means is visible when viewed along an axis perpendicular to said upper face of the caseband.

2. A watchcase according to claim 1, wherein said opaque unit comprises at least one ornamental element permanently secured to the glass, said flat frame being secured under said ornamental piece.

3. A watchcase according to claim 2, wherein the ornamental element permanently secured to the glass consists of a flat frame secured under the periphery of the glass, the frame to which said sockets are secured being made out of a base metal and provided with a recess and secured under the frame constituting said ornamental element, which wholly covers it, each one of said socket collars being positioned between the two frames in the recess of said frame of base metal.

4. A watchcase according to claim 3, wherein the frame constituting said ornamental element is composed of a plurality of narrow and flat bands of precious or semi-precious stones, the glass extending outwards up to the outer edge of the caseband.

5. A watchcase according to claim 3, wherein said glass extends up to the outer edge of said caseband, said frame constituting said ornamental element being made out of base metal and having its upper face, which is secured to said glass, finely machined so as to constitute a decorative design.

6. A watchcase according to claim 3, wherein said frame constituting said ornamental element is made out of hard metal and has only its inner area secured to said glass.

7. A watchcase according to claim 3, wherein said ornamental element consists of a thin coating vaporized in the vacuum under the glass periphery, said frame of base metal being secured to said coating, recesses being formed in the lower face of said frame and the collars of said sockets being welded to the bottom wall of said recess.

8. A watchcase according to claim 1, wherein borings are provided across said caseband, said borings having a larger upper portion with a diameter adjusted to that of said sockets and a narrower lower portion having a diameter adjusted to that of said screws, said sockets and said screws fitting said boring portions, respectively.

9. A watchcase according to claim 8, wherein an independent bottom is removably secured to said caseband, said glass securing screws simultaneously securing said bottom to said caseband.

10. A watchcase according to claim 1, wherein said glass consists of a sapphire constituting a protective shield for the exposed watchcase face.

* * * * *